United States Patent [19]

Hult

[11] 4,121,825

[45] Oct. 24, 1978

[54] PORTABLE FOOT ANCHOR FOR EXERCISING

[76] Inventor: Richard Thomas Hult, Apt. 92, 10345 S. Western Ave., Downey, Calif. 90241

[21] Appl. No.: 836,562

[22] Filed: Sep. 26, 1977

[51] Int. Cl.[2] ..... A63B 23/00

[52] U.S. Cl. ..... 272/93; 272/900

[58] Field of Search ..... 272/900, 143, 145, 144; 403/206; 160/DIG. 15, 327

[56] References Cited

U.S. PATENT DOCUMENTS

| | | | |
|---|---|---|---|
| 2,050,652 | 8/1936 | Fleming | 272/144 X |
| 2,425,971 | 8/1947 | Walker | 272/900 X |
| 2,622,663 | 12/1952 | Burd | 160/DIG. 15 |
| 4,060,240 | 11/1977 | Dunston | 272/900 X |

FOREIGN PATENT DOCUMENTS

| | | | |
|---|---|---|---|
| 1,421,162 | 11/1965 | France | 272/900 |
| 649,788 | 12/1962 | Italy | 272/900 |
| 942,707 | 11/1963 | United Kingdom | 272/900 |

*Primary Examiner*—Richard J. Johnson
*Attorney, Agent, or Firm*—William C. Babcock

[57] ABSTRACT

A portable foot anchor that removably engages the lower portion of a door when the latter is in a closed position to permit a sling that forms a part of the anchor to be engaged by a foot of the user.

The anchor when so disposed removably holds the foot of a user in a fixed position, and permits the user to exercise the balance of his body by moving desired portions thereof relative to the stationary positioned foot.

5 Claims, 4 Drawing Figures

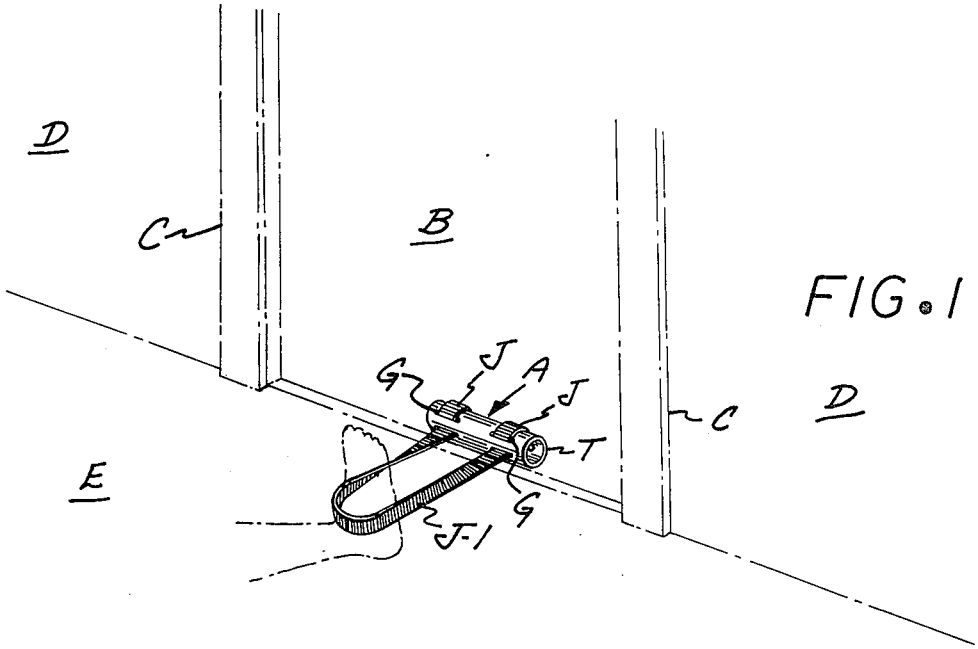
FIG. 1
FIG. 2
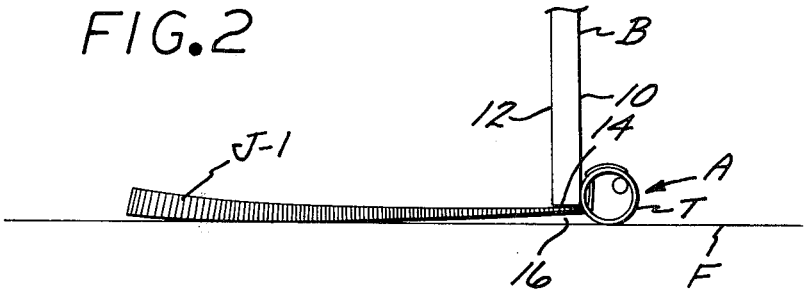
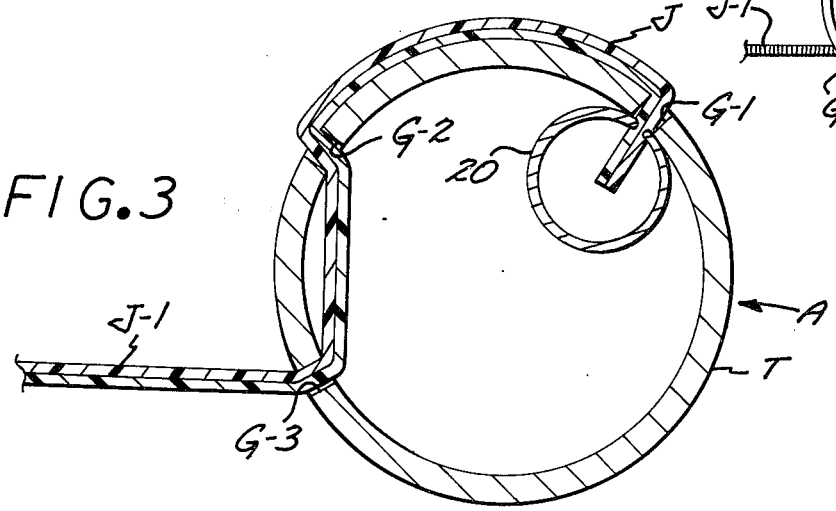
FIG. 3
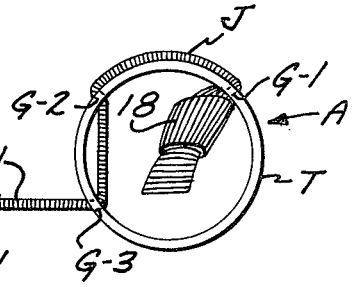
FIG. 4

PORTABLE FOOT ANCHOR FOR EXERCISING

BACKGROUND OF THE INVENTION

1. Field of the Invention

Portable foot anchor for exercising.

2. Description of the Prior Art

In exercising in a prone position, it is desirable to maintain one foot in a stationary position, while desired portions of the balance of the body are moved relative thereto. Previous to the present invention various exercising anchors have been devised and used, but such devices have the operational disadvantage that they must be permanently secured to a part of a building structure, or form a part of an exercising apparatus that is of such structure and design as to remain in a fixed position in a gymnasium or the like.

A major object of the present invention is to provide a portable, compact portable foot anchor for exercising that is light in weight and may be used for its intended purpose in any desired room that has a doorway leading thereto in which a door is hingedly suppored and which door may be positioned in a closed position.

Another object of the invention is to supply an exercising anchor that is of such structure that when it is in use it will not tend to cause the closed door to open, but will instead exert a force on the door in a direction to maintain the door in a closed position.

SUMMARY OF THE INVENTION

The foot anchor of the present invention may be carried into and used in any desired room that has a hinged door pivotally supported in a frame, with the frame of such structure as to prevent the door pivoting beyond a closed position. The door has a first side thereof exteriorly disposed relative to the room when the door is in a closed position. The lower edge surface of the door and the portion of the floor therebelow cooperate to define a transverse space therebetween.

The foot anchor includes a rigid light weight tube, which tube is of lesser length than the width of the door, and the tube having a diameter greater than the height of the transverse space. The tube has two sets of longitudinally spaced slots through which the end portions of an elongate pliable member are threaded, with the free ends of the pliable member being disposed within the tube having knots formed therein, and the knots of such size as to prevent them being withdrawn through the slots. The portion of the pliable member exteriorly of the tube is in the form of a loop or sling that may be removably engaged by the foot of a user.

The exercising anchor is used by sliding the loop through the transverse space with the tube adjacently disposed relative to the first side of the door. The door is now closed, and the loop used to pull the tube into abutting contact with the first side of the door. The loop may now be removably engaged by the foot of a user to hold the foot in a stationary position as portions of the balance of the user are moved relative thereto for exercising.

BRIEF DESCRIPTION OF THE DRAWINGS

FIG. 1 is a perspective view of the exercising anchor in removable engagement with the lower portion of a door when the latter is in a closed position, and a loop or sling that forms a part of the anchor extending into a room to be engaged by the foot of a user;

FIG. 2 is an end elevational view of the door and the exercising anchor in engagement therewith;

FIG. 3 is an enlarged transverse cross-sectional view of the exercising anchor, with the free ends of the pliable member having stops secured thereto, which stops are disposed within the tube; and FIG. 4 is the same view as shown in FIG. 3 but with the stops being knotted ends of the pliable elongate member.

DESCRIPTION OF THE PREFERRED EMBODIMENT

The foot anchor A for use in exercising is shown in perspective in FIG. 1 in combination with a hinge supported door B that is mounted in a frame C that forms a part of a wall D, which door when open permits entry or exit from a room E. The frame C acts as a stop to prevent the door swinging beyond a closed position into the room E. The door B as may be seen in FIG. 2 has first and second oppositely disposed side surfaces 10 and 12, and a lower edge surface 14 that cooperates with the floor F to define a transverse space 16. The first surface 10 is exteriorly disposed relative to the room E when the door is in a closed position.

Foot anchor A includes a rigid light weight tube T that is of a length less than the width of the door B, and the tube having a diameter substantially greater than the height of the space 16.

Tube T has two sets of longitudinally spaced slots G therein, with each set of slots G including first, second and third slots G-1, G-2 and G-3 that are circumferentially spaced from one another.

An elongate pliable member J is provided, preferably a woven nylon ribbon. The free end extremities of the pliable member J are situated within the tube T. The end portions of the member J extend upwardly through the first slots G-1, forwardly across the exterior surface of the tube T, downwardly and inwardly through the second slots G-2, and outwardly through the third slots G-3. The portions of the member J forwardly of the tube T, define a loop or sling J-1. In FIG. 4 the end extremities of the pliable member J are formed into knots 18 that are of greater transverse cross-section than the slots G, and act as stops to prevent the member being separated from the tube T.

In FIG. 3 it will be seen that rigid bodies 20 that are of greater transverse cross-section than the height of the space 16 may be secured by conventional means to the free ends of the pliable member J to serve the same function as stops as the knots 18.

The use and operation of the invention A is extremely simple. The loop J-1 is extended forwardly through the space 16, with the door B then being placed in the closed position shown in FIG. 1. The loop J-1 is now pulled forwardly and forces the tube T into abutting contact with the lower portion of the first side 10 of door B. The loop J-1 may now be removably engaged by the foot U of a user, with the foot being held in a substantially horizontal position when the balance of the body of the user is exercised. It will be noted in FIG. 2 that the pair of slots G-3 are so disposed and off-centered on the tube T, that when the loop J-1 is tensioned here is a direct pull on the tube. After the anchor A has served its intended purpose, it is removed from engagement with the door B, and the loop J-1 wound transversely about the tube B to permit the anchor to be stored in a minimum of space.

The use and operation of the invention has been described previously in detail and need not be repeated.

I claim:

1. In combination with a closable hinged vertically extending door supported in a door frame leading into a room, said frame preventing said door being pivoted beyond a closed position, said door having first and second sides and a lower edge that cooperates with the floor beneath said door to define a transverse space, said first side of said door exteriorly disposed to said room when said door is in a closed position a foot anchor for exercising, said foot anchor including:

a. an elongate rigid tube of less length than the width of said door, which tube has first and second sets of longitudinally spaced slots defined therein, with each of said sets including first, second and third longitudinal slots that are circumferentially spaced from one another, and said tube of a diameter greater than the height of said transverse space;

b. an elongate pliable member disposed in the form of a loop that has first and second free end portions that extend inwardly into said tube through said first slots of said first and second sets, outwardly from said tube through said second slots of said first and second sets, and inwardly into said tube through said third slots of said first and second sets; and c. means in said tube on the extremities of said first and second end portions that prevent said means being withdrawn from said tube through said third slots, with said tube when resting on said floor and in abutting contact with said first side of said door when the latter is in a closed position and said loop extending through said space and outwardly from said second side of said door into said room providing said anchor that may be engaged by a foot of a user when said user is exercising.

2. A foot anchor as defined in claim 1 in which said pliable member is a tubular woven nylon ribbon.

3. A foot anchor as defined in claim 2 in which said means are knots formed in the free extremities of said ribbon.

4. A foot anchor as defined in claim 1 in which said tube is formed from a lightweight metal.

5. A foot anchor as defined in claim 1 in which said means are rigid bodies of greater transverse cross-section than said slots secured to the free extremities of said ribbon.

* * * * *